US005507225A

United States Patent [19]

Noguchi et al.

[11] Patent Number: 5,507,225

[45] Date of Patent: Apr. 16, 1996

[54] STENCIL PRINTER EQUIPPED WITH PRINT IMAGE TRANSVERSE POSITION ADJUSTMENT MEANS

[75] Inventors: Yoshihiro Noguchi; Hiroshi Hanzawa; Yoshikazu Hara; Masakazu Miyata, all of Tokyo, Japan

[73] Assignee: Riso Kagaku Corporation, Tokyo, Japan

[21] Appl. No.: 332,069

[22] Filed: Nov. 1, 1994

[30] Foreign Application Priority Data

Nov. 12, 1993 [JP] Japan ..... 5-306032

[51] Int. Cl.[6] ..... B41F 15/38; B41F 13/14

[52] U.S. Cl. ..... 101/116; 101/248; 101/DIG. 36

[58] Field of Search ..... 101/114, 116, 101/117, 118, 119, 120, 248, 481, 485, 486, DIG. 36

[56] References Cited

U.S. PATENT DOCUMENTS

| | | | |
|---|---|---|---|
| 3,572,240 | 3/1971 | Bohm | 101/116 |
| 3,675,571 | 7/1972 | Vertegaal | 101/116 |
| 4,214,528 | 7/1980 | Mirow | 101/248 |
| 4,484,522 | 11/1984 | Simeth | 101/248 |
| 5,327,826 | 7/1994 | Rodi | 101/486 |

FOREIGN PATENT DOCUMENTS

| | | | |
|---|---|---|---|
| 52781 | 6/1982 | European Pat. Off. | 101/119 |
| 59-12894 | 1/1984 | Japan . | |
| 59-12893 | 1/1984 | Japan . | |
| 40179 | 2/1986 | Japan | 101/116 |

*Primary Examiner*—Stephen Funk

*Attorney, Agent, or Firm*—Stevens, Davis, Miller & Mosher

[57] ABSTRACT

In a stencil printer in which a printing drum is carried by a carrier mounted in a frame body of the printer to be transversely withdrawable from the frame body on its one side for maintenance, etc., the carrier is selectively engaged with a transverse position adjustment device at its operating position inside the frame body, wherein the transverse position adjustment device engages the carrier to adjust its transverse position for adjustment of transverse position of print image via a latching mechanism so that, when the carrier is to be disengaged from the transverse position adjustment device for the withdrawal, the transverse position adjustment device once shifts the carrier to its terminal biasing position toward the withdrawal direction and returns to its standard transverse position, while disengaging the latching mechanism at the moment of reversing its biasing movement.

4 Claims, 6 Drawing Sheets

STENCIL PRINTER EQUIPPED WITH PRINT IMAGE TRANSVERSE POSITION ADJUSTMENT MEANS

BACKGROUND OF THE INVENTION

1. Field of the Invention

The present invention relates to the technical field of the stencil printing, and more particularly to an improvement of a stencil printer so that the transverse position of the print image by a stencil printer is more easily and finely adjusted. In the present specification the term "transverse position" means a position specified along the direction of extension of the central axis of the printing drum.

2. Description of the Prior Art

In conventional rotary type stencil printers equipped with a printing drum, the printing drum is mounted in a printer frame body to be rotatable about a central axis thereof at a fixed transverse position relative to the printer frame body. In those conventional stencil printers, an adjustment of the transverse position of the print image is available by appropriately adjusting the mounting position of a stencil sheet to the printing drum with respect to its transverse position when it is done before the stencil sheet is mounted around the printing drum, or regardless of before or after the mounting of the stencil sheet to the printing drum, an adjustment of the printed image transverse position is available by shifting a print sheet feed means in the transverse direction relative to the printing drum.

However, the shifting of a stencil sheet or a print sheet relative to the printing drum in the transverse directions along the central axis of the printing drum requires that the stencil sheet or the printing sheet, which has a rectangular configuration generally longer in the direction perpendicular to the direction of transverse movement than in the direction of printing movement, is shifted correctly in the direction of transverse movement, in spite of the requirement that such a transverse adjustment for print image should generally be fine and precise. In order to meet with such requirements, the means for transversely shifting a stencil sheet feed means or a print sheet feed means relative to the printing drum requires a precise parallel guide means including at least a pair of guide rails or the like spaced apart from one another in the direction of feeding the stencil sheet or the print sheet and delicate driving means for shifting the stencil sheet feed means or the print sheet feed means along such a pair of guide rails or the like at respective corresponding portions exactly in synchronization.

SUMMARY OF THE INVENTION

In view of the above-mentioned requirements of complicated constructions for transversely shifting the stencil sheet feed means or the print sheet feed means along the central axis of the transversely fixed printing drum for the adjustment of the transverse position of the print image, it is an object of the present invention to provide a stencil printer improved such that a fine adjustment of the transverse position of the print image is readily and precisely accomplished by a simple means.

According to the present invention, the above-mentioned object is accomplished by a stencil printer comprising a printing drum carriage means supporting a printing drum to be freely rotatable at a predetermined axial position thereof and suspended from a frame body of the printer to be movable in the direction of extension of a central axis of said printing drum relative to said printer frame body so as to move said printing drum between an operating position thereof located inside of the printer and a dismounting position located outside of the printer. The invention comprises a print image transverse position adjustment means acting between said printing drum carriage means and said printer frame body for finely adjusting the position of said printing drum located at said operating position thereof relative to said printer frame body along the central axis thereof.

Further, according to the present invention, the above-mentioned object is accomplished in a more desirable mode by the stencil printer of the above-mentioned basic construction, wherein said print image transverse position adjustment means comprises a standard position detection means for detecting a standard transverse position of said printing drum carriage means relative to said printer frame body, a bias measurement means for measuring a transverse biasing amount of said printing drum carriage means relative to said printer frame body from said standard transverse position, and a transverse position instruction means for instructing a change of the print image transverse position, and adapted to return the transverse position of said printing drum carriage means relative to said printer frame body to said standard transverse position in response to a return instruction signal from said transverse position instruction means, and to change the transverse position of said printing drum carriage means relative to said printer frame body in response to a leftward or rightward bias instruction signal from said transverse position instruction means while detecting a biasing amount by said bias measurement means.

Further, according to the present invention, the above-mentioned object is accomplished in a more desirable mode by the stencil printer of the above-mentioned basic construction, wherein said print image transverse position adjustment means further comprises a transverse amount memory means for storing a transverse amount measured by said bias measurement means, and is adapted to operate for reproducing said bias amount stored by said bias amount memory means after the transverse position of said printing drum carriage means relative to said printer frame body has been returned to said standard transverse position.

According to the present invention, the above-mentioned object is accomplished in a further more desirable mode by the stencil printer of the above-mentioned basic construction, further comprising a print image position indication means for indicating the transverse adjustment position of the print image by said print image transverse position adjustment means, said print image position indication means comprising means for indicating a standard print position indication mark of a rectangular configuration representing a print sheet, and a biased print position indication mark of a rectangular configuration adapted to change a transverse position thereof relative to said standard print position indication mark in accordance with the transverse biasing amount from said standard transverse position instructed by said transverse position instruction means.

Still further, according to the present invention, the above-mentioned object is accomplished in a further more desirable mode by the stencil printer of the above-mentioned basic constructions, wherein said print image transverse position adjustment means comprises a first connection element provided on a side of said printing drum carriage means and a second connection element provided on a side of said printer frame body, said first and second connection elements being adapted to hold mutual relative movement along the central axis of said printing drum by a lateral groove formed in one of said first and second connection elements to be substantially perpendicular to the central axis of said printing drum being selectively engaged by a lug movably mounted on the other one of said first and second connection elements, and further comprises a disengagement instruction means for instructing said lug to move from an engagement position in said lateral groove out of said lateral groove, and is adapted to drive said printing drum carriage means either leftward or rightward relative to said printer frame body when the disengagement was instructed by said disengagement instruction means, and thereafter to reverse the direction of the driving, while simultaneously moving said lug from the inside of said lateral groove to the outside thereof.

A stencil printer having a stencil printer carriage means supporting a printing drum to be freely rotatable at a predetermined axial position and suspended by a printer frame body to be movable along the central axis of the printing drum relative to the printer frame body so as to move the printing drum between an operating position within the printer frame body and a discharge position outside of the printer frame body is disclosed in Japanese Patent Laid-open Publication 59-12894 based upon an application filed by the same assignee as that of the present application. The printing drum carriage means of such a stencil printer is constructed to have a slender construction extending along the central axis of the printing drum due to an obvious requirement that it must house an elongated printing drum to be movable between the operating position within the printer frame body and the dismounting position outside of the printer frame body with a necessary minimum spacing left therearound. Therefore, such a printing drum carriage means is highly stable in guiding the axial movement of the printing drum along the direction of slender extension thereof relative to the printer frame body, and particularly when such a printing drum carriage means is at the position finally inserted into the printer frame body to bring the printing drum to the operating position thereof, the guiding of the printing drum carriage means relative to the printer frame body is most stabilized. Therefore, even when the printing drum carriage means is subjected to a force in the direction of extension of the printing drum at any optional portion thereof, the printing drum carriage means can smoothly move along the central axis of the printing drum without causing any transverse swinging.

Therefore, in the stencil printer equipped with the above-mentioned type printing drum carriage means, when a means for adjusting the axial position of the printing drum carriage means relative to the printer frame body is provided to act at any portion of the printing drum carriage means, more desirably at a portion thereof close to the central axis of the printing drum, such a means, even if it is a simple means, can easily, finely and precisely adjust the transverse position of the print image by such a means being operated after a stencil sheet has been mounted around the printing drum.

Further, in the stencil printer of the above-mentioned construction, when the print image transverse position adjustment means is adapted to return the transverse position of the printing drum carriage means relative to the printer frame body to the standard position in response to the return instruction signal from the transverse position instruction means or to bias the transverse position of the printing drum carriage means leftward or rightward from the standard position in response to the biasing instruction signal from the transverse position instruction means while measuring the biasing amount by the bias measuring means, the transverse position of the printing drum carriage means relative to the printer frame body can be adjusted by employing a relatively simple unit drive means such as a pulse motor, a means for detecting a single point to be a standard position, and a simple electronic circuit for counting electric pulses.

Further, in the stencil printer of the above-mentioned construction, when the print image transverse position adjustment means is adapted to store the biasing amount measured by the bias measuring means in a bias amount memory means and to reproduce the biasing amount stored in the biasing amount memory means after the transverse position of the printing drum carriage means relative to the printing frame body has been returned to the standard position, the relative transverse position between the printer frame body and the printing drum carriage means is automatically regained even when the printing drum has once been moved out of the printer frame body together with the printing drum carriage means for the inspection or maintenance of the printing drum or the relative transverse position between the printer frame body and the printing drum carriage means has once been optionally changed or modified for the convenience of disassembling the printing drum carriage means out of the printer frame body.

Still further, when the transverse set position of the printing drum carriage means relative to the printer frame body adjusted by the print image transverse position adjustment means is indicated by the contrast of the standard printing position indication mark representing a print sheet and a rectangular biased print position indication mark adapted to change its transverse position relative to the standard printing position indication mark according to the transverse biasing amount from the standard position instructed by the transverse position instruction means, the setting of the transverse position of the print image by the print image transverse position adjustment means is directly and clearly observable by the operator of the stencil printer. In this connection, when the stencil printer according to the present invention further incorporates a print image longitudinal position adjustment means proposed by Japanese Patent Application 5-306033 filed by the same assignee as the present application, the above-mentioned print image position indication means may be constructed such that the above-mentioned biased print position indication mark is shifted relative to the standard print position indication mark in the transverse direction according to the operation of the print image transverse position adjustment means according to the present invention and also shifted in the longitudinal direction relative to the standard print position indication mark according to the operation of the above-mentioned print image longitudinal position adjustment means.

Still further, in the stencil printer of the above-mentioned construction, wherein it is so adapted that the print image transverse position adjustment means prevents the axial relative movement between the afore-mentioned first and second connection elements by the lug movably provided on one of them being selectively engaged into the transverse groove formed in the other of them, while the lug engaged into the transverse groove is moved out of the engagement with the transverse groove in accordance with the latch disengaging instruction given from the latch disengagement instruction means, when it is so adapted that, upon a latch disengaging instruction by the latch disengagement instruction means, the printing drum carriage means is driven in one of the opposite transverse directions relative to the printer frame body and then the direction of movement thereof is reversed with a simultaneous disengagement of the lug out of the transverse groove, it is avoided that the disengagement of the lug from the transverse groove fails due to a sticking or the like which would cause a false driving of the printing drum carriage means, thus ensuring a positive latch disengaging operation based upon a small powered lug driving means such as a solenoid or the like.

BRIEF DESCRIPTION OF THE DRAWING

In the accompanying drawing.

DESCRIPTION OF THE PREFERRED EMBODIMENT

In the following the present invention will be described in detail with respect to an embodiment thereof with reference to the accompanying drawing.

Figure 1:
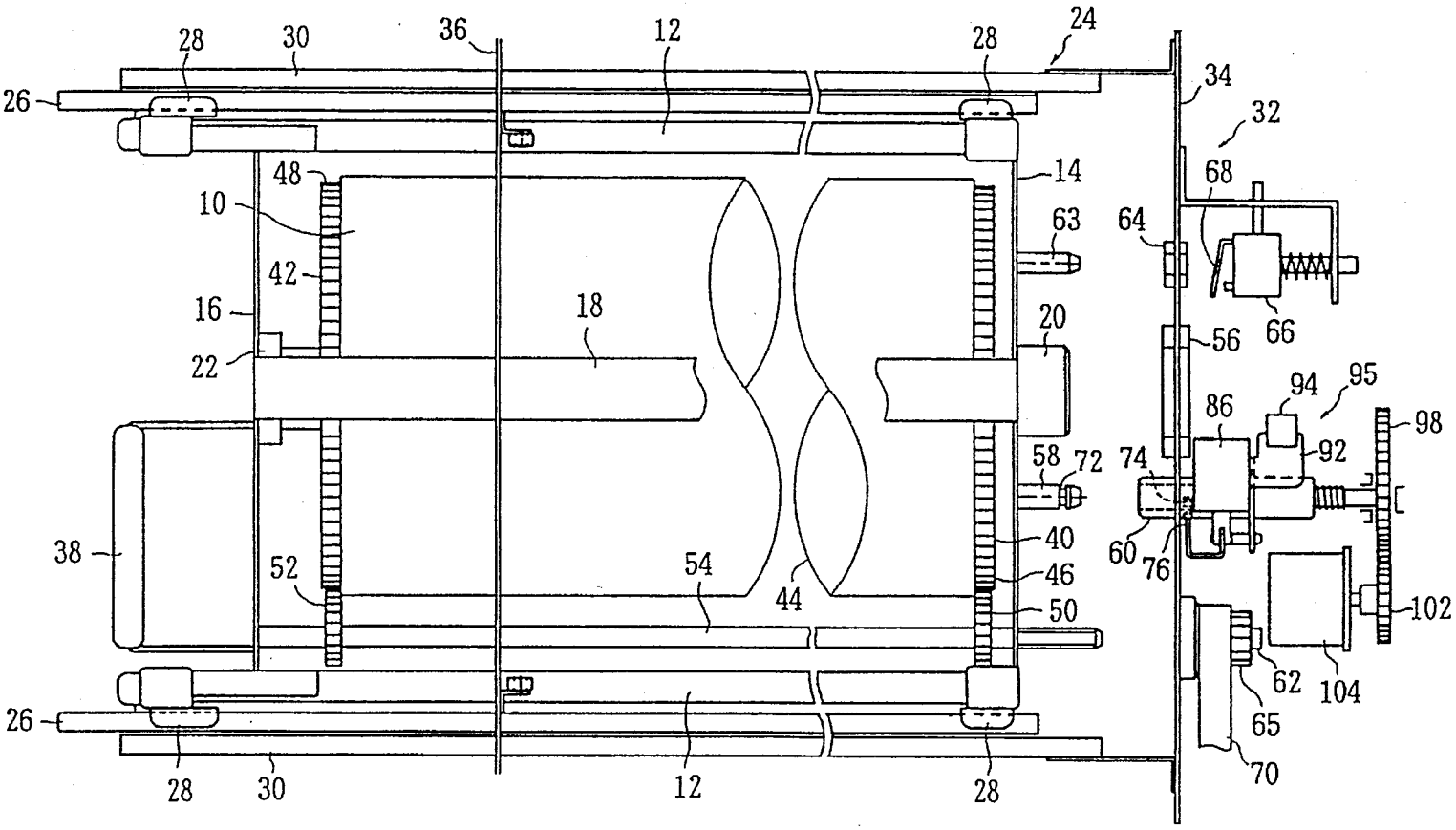
FIG. 1 is a front view of an embodiment of the stencil printer according to the present invention, showing portions of a printer frame body, a printing drum carriage means, and means for finely adjusting the axial position of the printing drum.
Figure 2:
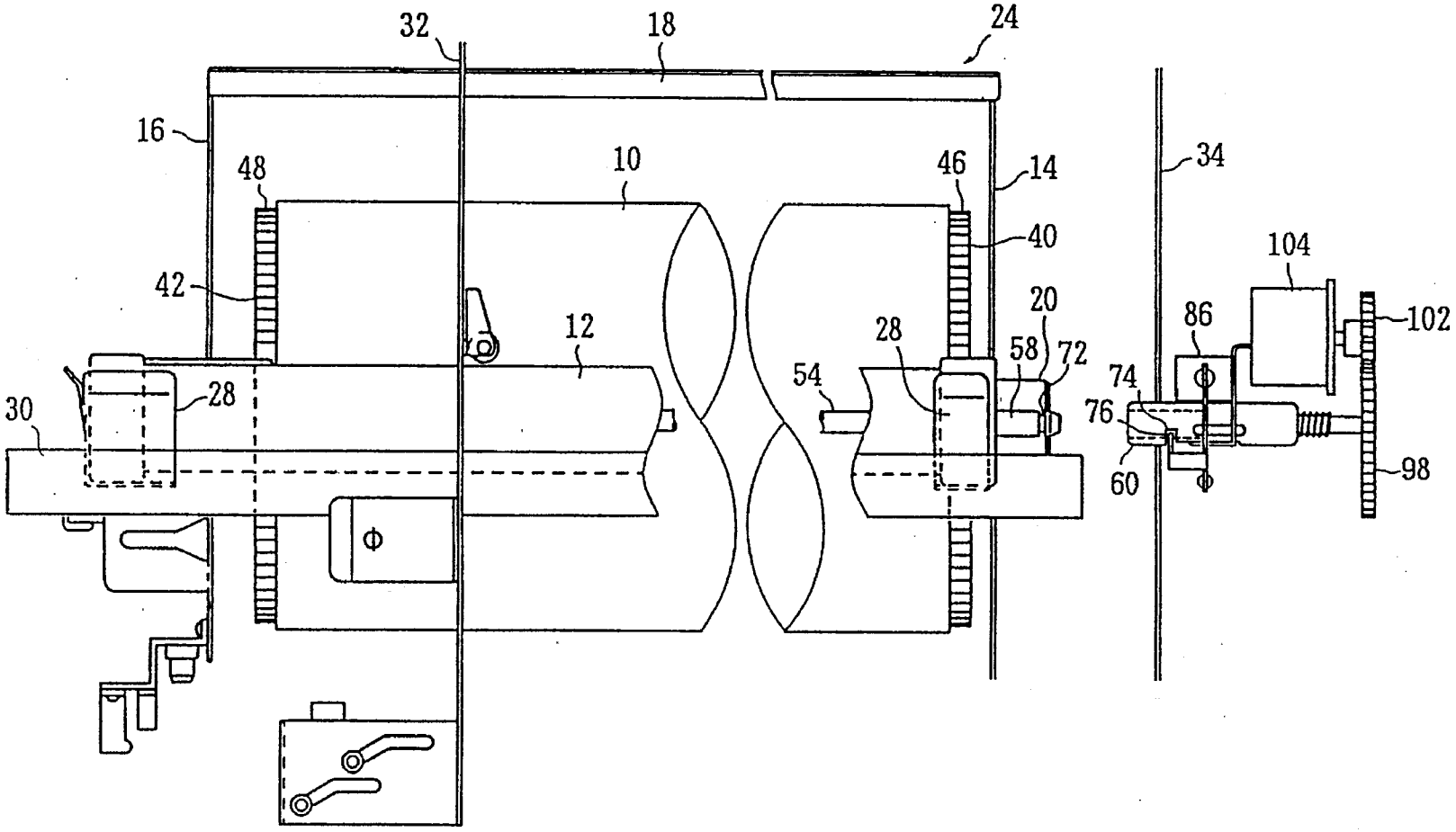
FIG. 2 is a side view of the portions shown in FIG. 1.
Figure 3:
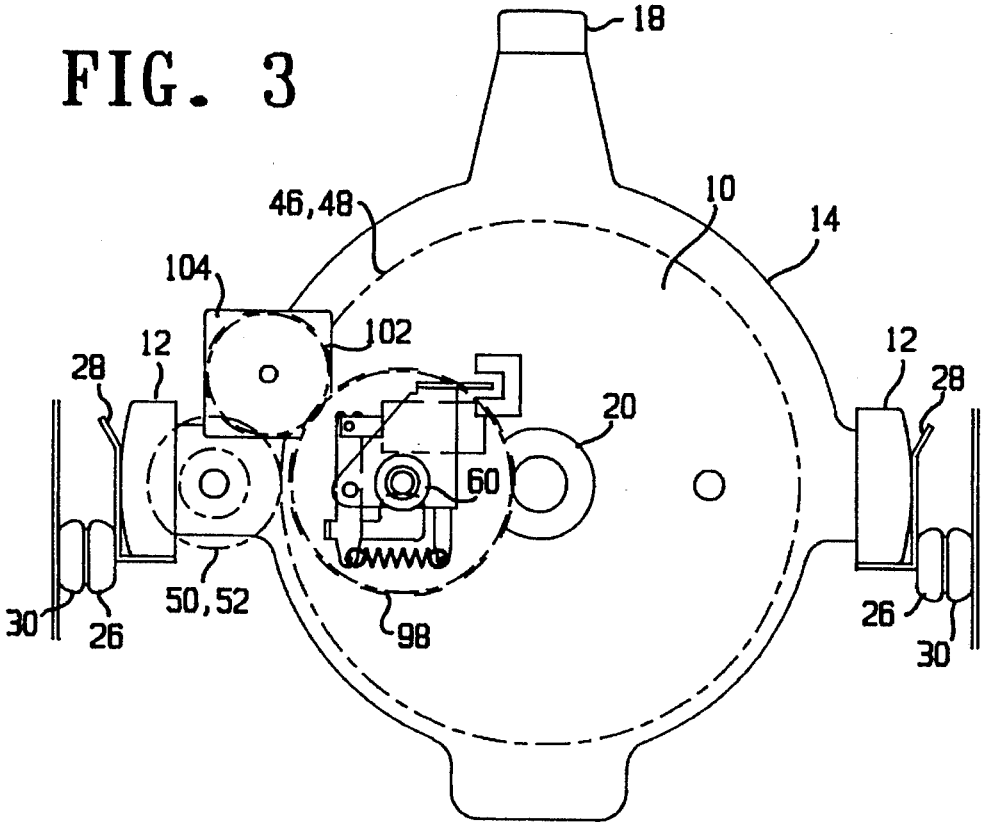
FIG. 3 is an end view of the portions shown in FIGS. 1 and 2.
Figure 4:
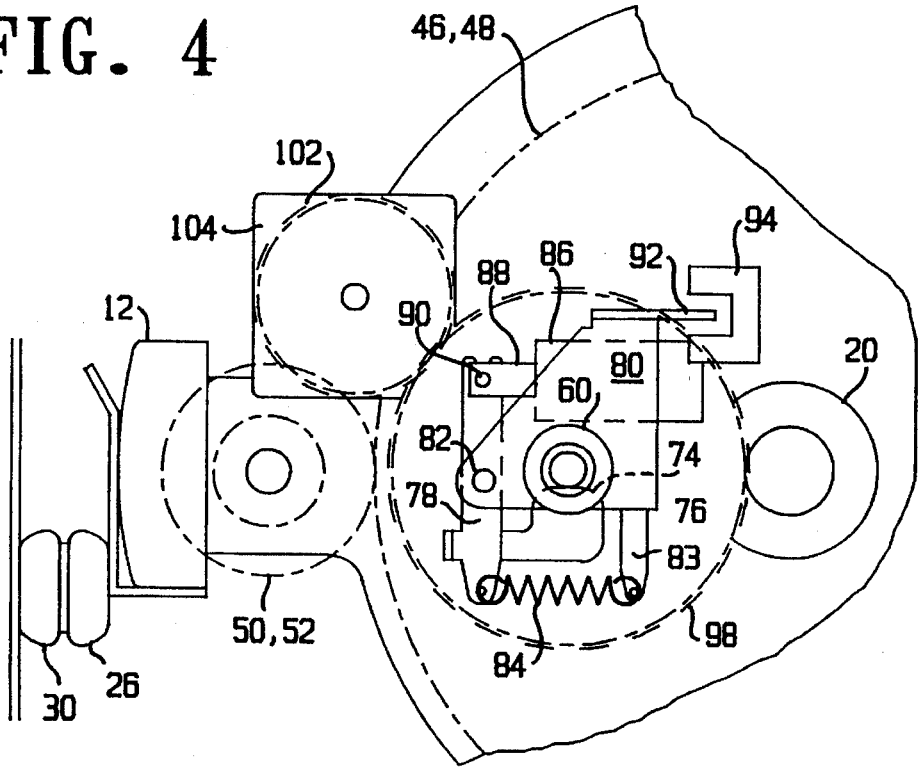
FIG. 4 is an end view on an enlarged scale of a part of FIG. 3.
Figure 5:
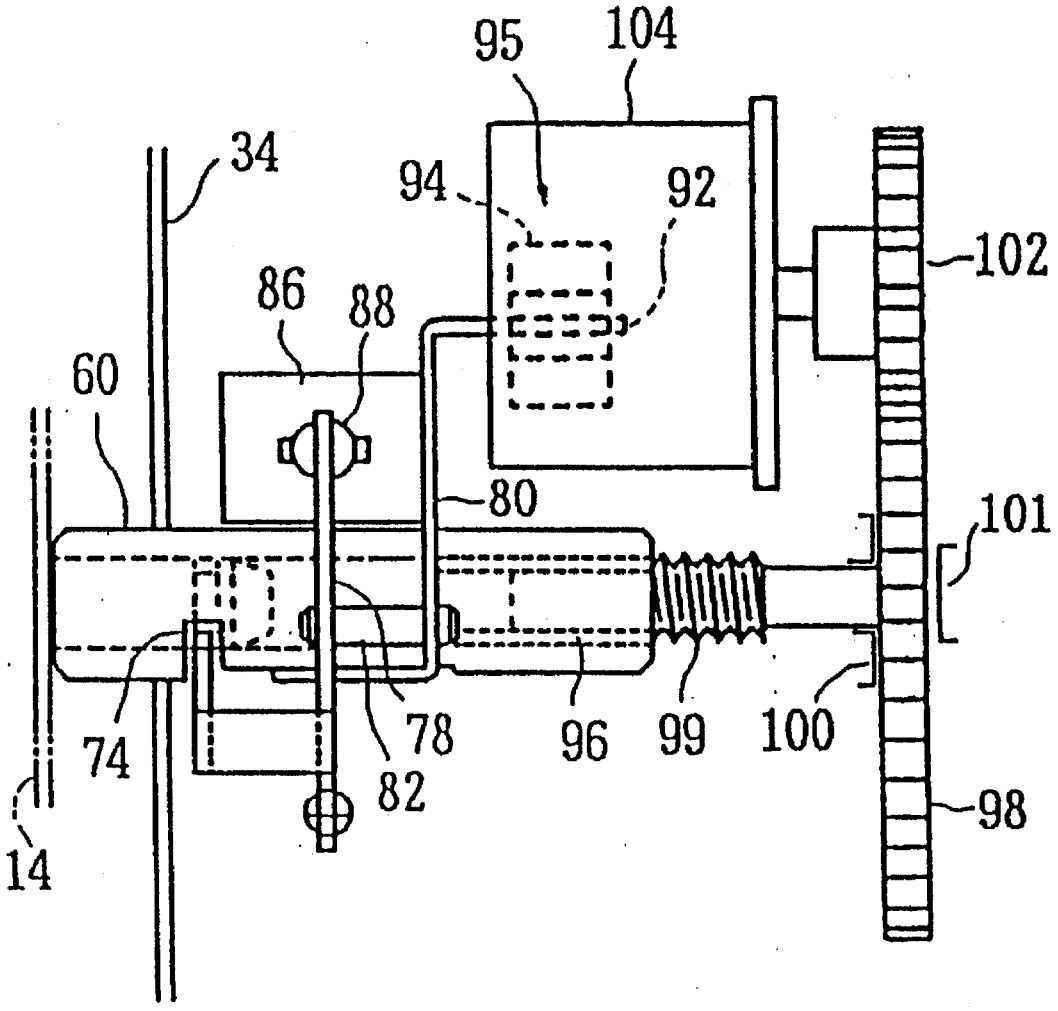
FIG. 5 is a side view of the part corresponding to FIG. 4.

Referring to FIGS. 1, 2 and 3, there is shown by front, side and end views an embodiment of the stencil printer according to the present invention with respect to the construction of the printing drum carriage means, the means for suspending the printing drum carriage means to be movable in the direction of extension of the central axis of the printing drum relative to the printer frame body, and the print image transverse position adjustment means acting between the printing drum carriage means and the printer frame body so as to finely adjust the axial position of the printing drum positioned at the operating position thereof relative to the printer frame body. FIG. 4 is an end view similar to FIG. 3, showing a part of the construction shown in FIG. 3 in a somewhat enlarged scale for the clarity of illustration, and FIG. 5 is a side view showing a part of the construction shown in FIG. 2 in an enlarged scale. In these figures, corresponding portions are designated by corresponding reference numerals.

In these figures, 10 is a printing drum which is supported by a printing drum carriage means 24 constructed of a pair of side frames 12, and plates 14 and 16, a handle member 18, bearings 20 and 22, etc. The printing drum 10 is supported by the printing drum carriage means 24 at the bearings 20 and 22.

The printing drum carriage means 24 is suspended such that the pair of side frames 12 are suspended by a pair of intermediate movable rails 26 via fittings 28 fixed to the movable intermediate rails. The pair of intermediate movable rails 26 are supported by a pair of corresponding stationary rails 30 to be movable therealong. The pair of stationary rails 30 are supported by side plates 34 and 36 forming a part of the printer frame body 32.

The printing drum carriage means 24 is provided with a handle 38 attached to the plate 16 for the convenience of the operator to move the printing drum carriage means along the central axis of the printing drum.

In the condition shown in FIGS. 1 and 2, the printing drum carriage means 24 is positioned at a position slightly drawn out in the leftward direction as viewed in the figure relative to the printer frame body 32 from the innermost position of the rightward movement thereof in the figure in the printer frame body 32 where the printing drum 10 is positioned at the operating position thereof. When the printing drum carriage means 24 is further moved leftward relative to the printer frame body 32, the printing drum carriage means 24 is completely drawn out of the side plate 36 of the printer. In such a condition, when the operator lifts the printing drum carriage means 24 by grasping it at the handle member 18 upward so that the pair of side frames 12 are disengaged from the suspending engagement with the fittings 28 mounted on the intermediate movable rail 26, the printing drum 10 is completely dismounted from the remaining parts of the printer together with the printing drum carriage means in a condition incorporated therein.

The printing drum 10 has a pair of disk members 40 and 42 forming opposite axial ends thereof and a transverse bar member (not shown in the figure) extending in parallel with the central axis of the printing drum so as to connect the pair of disk members with one another (although the disk members 40 and 42 and the transverse bar member may be the respective parts of a unitary construction), and further a rectangular flexible perforated sheet 44 fixed at one end thereof to the transverse bar member and extending toward the other end thereof with opposite side edge portions thereof freely seated around the outer circumferential surfaces of the disk members 40 and 42 so as to be rounded into a cylindrical configuration. The disk members 40 and 42 are formed with gear wheels 46 and 48 along one side circumference thereof. The printing drum 10 is driven to rotate uniformly so as not to get skewed by being driven by pinions 50 and 52 meshing with the gear wheels 46 and 48 and driven for rotation by a common shaft 54.

When the printing drum carriage means 24 is pushed rightward in the figure relative to the printer frame body 32 from the position shown in FIGS. 1 and 2, the bearing means 20 engages into an annular bearing support member 56 provided at the side plate 34 of the printer frame body, while on the other hand an engagement rod 58 provided to project from the side plate 14 of the printing drum carriage means in parallel with the central axis of the printing drum engages into a socket 60 provided for receiving the engagement rod, and still further a splined end portion of the shaft 54 of the pinions engages into a corresponding splined bore of a drive shaft 62 provided in alignment therewith, and still further a contact rod 63 provided to project from the end plate 14 in parallel with the central axis of the printing drum passes through a bore of an annular member 64 provided at the side plate 34 in alignment therewith until a filler element 68 of a limit switch 66 is contacted thereby. The drive shaft 62 carries a pulley 65 and is driven by an endless belt 70 engaged therearound so as to drive the shaft 54 of the pinions 50 and 52 and to rotate the printing drum 10 via the geared portions of the disk members 40 and 42.

The engagement rod 58 is formed with a transverse annular groove 72 adjacent the forward end thereof, while the socket 60 is formed with a transverse groove 74 adapted to align with the transverse annular groove 72 of the engagement rod 58 when it has been fully inserted into the socket. A lug 76 is provided to traverse the transverse groove 74 of the socket such that when the annular transverse groove 72 aligns with the transverse groove 74 of the socket, the lug 76 is engaged further into the groove 72 so as to latch the engagement rod 58 to the socket against relative axial movements therebetween. The lug 76 is supported by a link 78 which is pivotably supported from a bracket 80 fixed to the socket 60 via a pivot shaft 82. The link 78 is biased to turn around the pivot shaft 82 in the anti-clockwise direction as viewed in FIG. 4 by an expansion coil spring 84 mounted between one end thereof and an arm 83 extended from the bracket 80 so that the lug 76 is biased in the direction to be engaged into the transverse groove 74. The other end of the link 78 is connected with an armature 88 of a solenoid 86 mounted to the socket 60 by a pivot shaft 90 so that when the solenoid 86 is energized, the link 78 is turned in the clockwise direction around the pivot shaft 82 as viewed in FIG. 4 against the spring force of the expansion coil spring 84, thereby removing the lug 76 out of the transverse groove 74, thereby disengaging the axial latching between the engagement rod 58 and the socket 60.

A tongue member 92 mounted to the bracket 80 cooperates with a light sensor 94 mounted to the printer frame body 32 to construct a standard position detection means 95 for detecting the position of the socket 60 relative to the printer frame body 32 in the axial movement thereof so that when the socket 60 has come to the standard position relative to the printer frame body 32, it is so detected. The socket 60 is adapted to move in the axial direction with the bracket 80 and the solenoid 86 mounted thereto by being restricted against rotation about the central axis thereof by guide means not shown in the figure.

The socket 60 formed with a threaded bore 96 at an end portion thereof opposite to the end adapted to engage with the engagement rod 58, and a threaded shaft 99 bearing an integral gear wheel 98 is screwed into the threaded bore 96. The threaded shaft 99 with the gear wheel 98 is supported by bearing means 100 and 101 to be rotatable about the central axis thereof but not shiftable in the axial direction. The gear wheel 98 is meshed with a gear wheel 102 which is supported and driven by a pulse motor 104 supported from the printer frame body.

Figure 6:
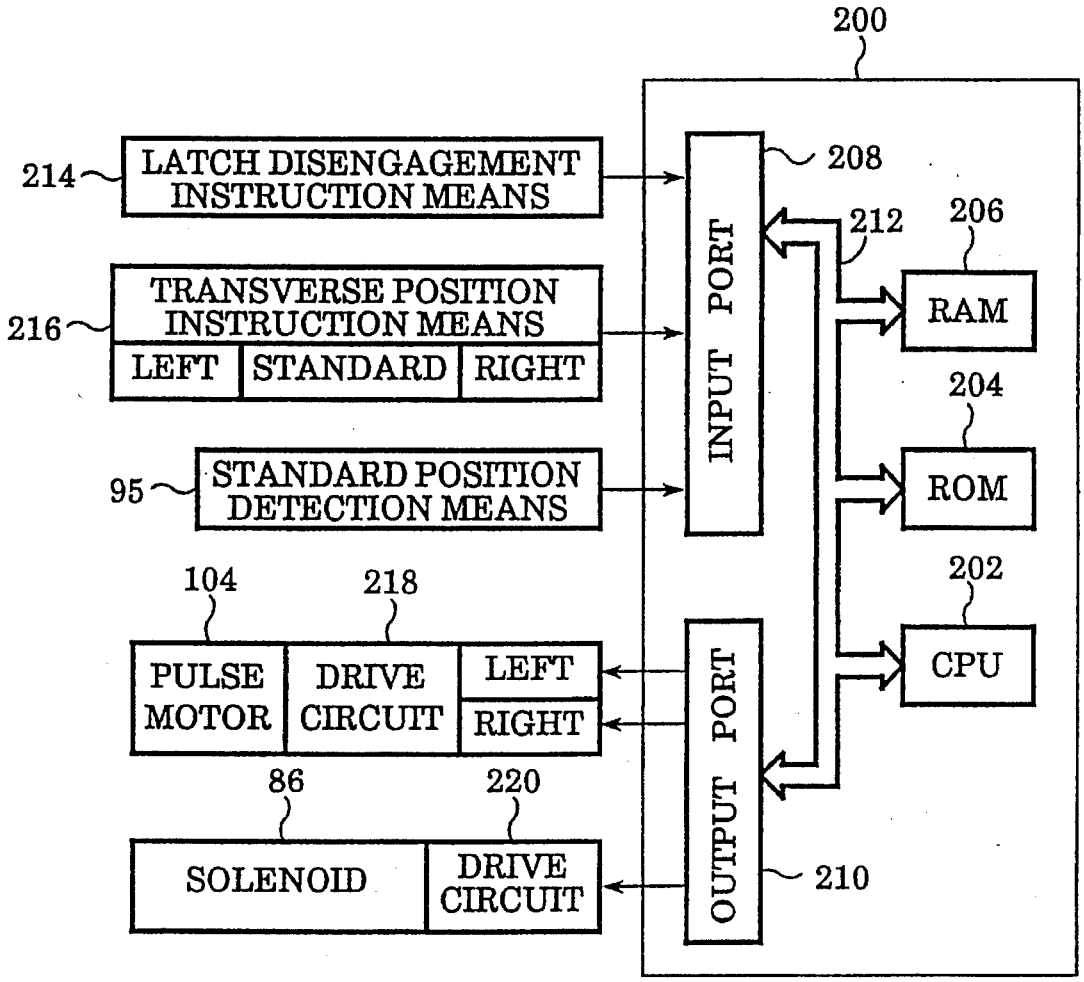
FIG. 6 is a diagrammatical view of the control means for controlling the operation of the devices shown in FIGS. 1–5.

FIG. 6 is a diagram showing a control means employing a micro computer for controlling the operation of the stencil printer according to the present invention. The micro computer herein shown and designated by 200 has a common construction well known in this art, comprising a central processing unit (CPU) 202, a read only memory (ROM) 204, a random access memory (RAM) 206, an input port means 208, an output port means 210 and a big-directional common bus 212 interconnecting these elements with one another. The control means control the overall operation of the stencil printer, with the input port means 208 and the output port means 210 being respectively connected with a number of signal dispatching means and signal receiving means other than those shown in FIG. 6 in which there are shown only those concerned with the print image transverse position adjustment means. Thus, the micro computer 200 is supplied with a signal for dissolving the latching of the printing drum carriage means at the operating position thereof dispatched from a latch disengagement instruction means 214 such as a push button provided at an appropriate position such as an inside of a door provided around the mounting position of the printing drum carriage means 24 in the printer frame body and opened when the printing drum carriage means is drawn out of the printer, the push button being pushed prior to the drawing-out of the printing drum carriage means, a return instruction signal for returning the printing drum carriage means to the standard position or a transverse position instruction signal for biasing the printing drum carriage means to the leftward or the rightward as much as a determinate amount from a transverse position instruction means 216 provided at a control panel of the stencil printer, and a standard position detection signal indicating if the transverse position of the printing drum carriage means relative to the printer frame body is at the standard position from the standard position detection means 95 including the tongue piece 92 and the light sensor 94 through the input port means 208, and dispatches through the output port means 210 a pulse motor driving signal to a driving circuit 218 for operating the pulse motor 104 to drive the printing drum carriage means leftward or rightward relative to the printer frame body, and a solenoid driving signal to a drive circuit 220 for actuating the solenoid 86 to disengage the lug 76 out of the annular transverse groove 72 formed at the engagement rod.

Figure 7:
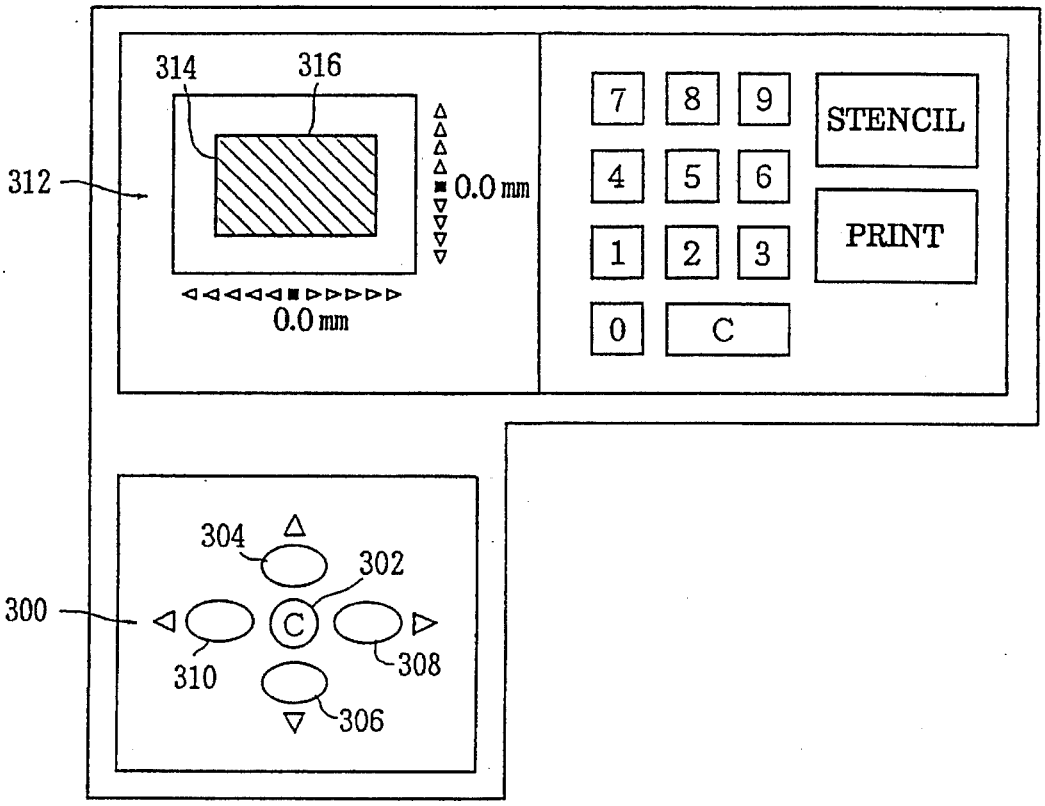
FIG. 7 is a diagrammatical front view of the control panel.

FIG. 7 is a plan view of a control panel for the overall control of the operation of the stencil printer into which the present invention is incorporated, the control panel including a portion concerned with the print image transverse position adjustment means. In FIG. 7, the portion shown by 300 is a print image position instruction means which includes the transverse position instruction means as a part thereof. In this portion the longitudinal position instruction means is also incorporated. In more detail, when a push button 302 is pushed, it is instructed to return the transverse position of the printing drum carriage means relative to the printer frame body to the standard position, and at the same time it is also instructed to return the longitudinal position of the print image adjusted by the print image longitudinal position adjustment means incorporated into the stencil printer to the standard position. 304 is a leftward biasing instruction button which, when pushed once, instructs to bias the transverse position of the printing drum carriage means relative to the printer frame body leftward from the standard position as much as a predetermined unit value. 306 is a rightward biasing instruction button, which, when pushed once, instructs to bias the printing drum carriage means relative to the printer frame body from the standard position rightward as much as a predetermined unit value. 308 and 310 are an upward biasing instruction button and a downward biasing instruction button for instructing an upward biasing and a downward biasing respectively of the print image as much as a predetermined unit value.

Figure 8:
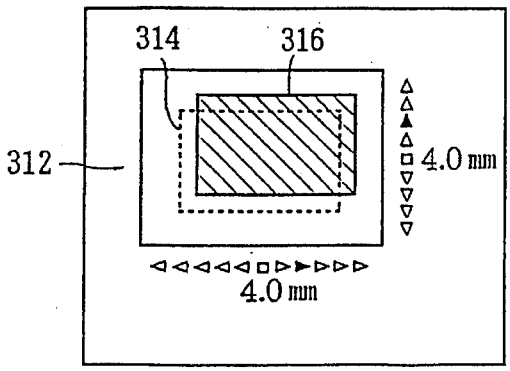
FIG. 8 is a view showing a manner of indication by the print image position indication means in the control panel.

In FIG. 7, the portion designated by 312 is a print image position indication means for indicating the degree of biasing of the print image from the standard position by the print image position adjustment means. The print image position indication means shown in the figure is constructed to show the degree of the transverse position adjustment of the print image according to the print image transverse position adjustment means according to the present invention and also to show the degree of the longitudinal position adjustment of the print image by the longitudinal position. adjustment means according to the aforementioned Japanese Patent Application 5-306033. The print image position indication means 312 includes a standard print position indication mark 314 of a rectangular configuration showing the standard positions with respect to the transverse position of the printing drum carriage means relative to the printer frame body and the relative rotation angle position between the printing drum and the back press roller in the aforementioned copending application, and a biased print position indication mark 316 of a rectangular configuration indicating the biasing amount of the transverse biasing from the standard position of the printing drum carriage means relative to the printer frame body effected by the print image transverse position adjustment means and the biasing amount of the longitudinal biasing from the standard relative rotation angle position between the printing drum and the back press roller. An example of the biased print position indication mark 316 having been biased relative to the standard print position indication mark 314 is shown in FIG. 8. In the condition shown in FIG. 8, the printing drum carriage means is biased from the standard position leftward relative to the printer frame body, and at the same time the print image is biased upward from the standard position by a corresponding adjustment of the relative rotation angle between the printing drum and the back press roller by the print image longitudinal position adjustment means.

In the above-mentioned construction, starting from the condition wherein the printing drum 10 is at the operating position thereof within the printer frame body 32 as carried by the printing drum carriage means 24, with the engagement rod 58 being latched to the socket 60 by the lug 76 against the axial relative movement, such that the printer is in a normal operating condition, when the printing drum is to be drawn out of the printer frame body for a maintenance or inspection, the latch disengagement instruction means 214 is operated so as to dispatch the latch disengagement instruction signal which starts the following latch disengagement operation. First, in the micro computer 200, the biasing measurement means for measuring the transverse biasing amount from the standard position of the printing drum carriage means relative to the printer frame body, constructed by the means for counting the pulses supplied to the pulse motor 104 and the standard position detection means 95 comprising the tongue piece 92 and the light sensor 94, are put into operation, with electric pulses being supplied to the pulse motor 104 such that the printing drum carriage means is moved toward the drawing out direction, while counting the electric pulses supplied to the pulse motor. Since the starting biased transverse position of the printing carriage means relative to the printer frame body is memorized by the biasing measurement means as a count number of the electric pulses supplied to the pulse motor 104 when said biased transverse position was attained starting from the standard position directly detectable by the standard position detection means 95 comprising the tongue piece 92 and the light sensor 94, when the printing drum carriage means reaches a predetermined terminal position of the movement adjustable by the print image transverse position adjustment means, the attainment is detected by the biasing measurement means based upon the counting of a corresponding number of the electric pulses supplied to the pulse motor, and then the supply of electric pulses to the pulse motor 104 is reversed such that the socket 60 is now driven in the opposite direction (i.e. rightward in FIG. 1). At the time of the reversal of the driving direction, the solenoid 86 is energized so that the lug 76 is removed from the annular transverse groove 72. When the lug 76 is driven in the disengagement direction from the annular transverse groove 72 at the moment of reversal of the direction of driving of the printing drum carriage means 24 by the socket 60 via the engagement rod 58 as described above, it is avoided that the lug 76 remains in the annular transverse groove 72 in sticking engagement condition, so that the lug 76 is definitely disengaged from the annular transverse groove 72 even when it is driven by a small driving force. Then the operator may draw the printing drum carriage means 24 out of the printer frame body by pulling on the handle 38 so that the printing drum 10 is taken out of the printer frame body together with the printing drum carriage means. When the printing drum carriage means has been moved in the drawing out direction, it is detected by the limit switch 66, and it is shown by an indicator being put on.

After having been disengaged from the engagement rod 58, the socket 60 is returned to a position to set the printing drum carriage means at the standard transverse position relative to the printer frame body by the pulse motor 104 being further supplied with driving pulses, and when it was detected by the standard position detection means 95 having tongue piece 92 and light sensor 94 that the socket 60 was returned to the standard position, the supply of the pulses to the pulse motor 104 is stopped, and the solenoid 86 is deenergized, so that the lug 76 is returned to the position where it is engaged into the transverse groove 74 by the action of the expansion coil spring 84, to be ready for the remounting of the printing drum carriage means.

When the printing drum carriage means 24, after once having been moved in the drawing out direction at least to the position where the latching connection between the engagement rod 58 and the socket 60 is disengaged, is returned toward the operating position such that the tapered tip end of the engagement rod 58 pushes up the lug 76 until the annular transverse groove 72 aligns with the transverse groove 74, the lug 76 is engaged into the annular transverse groove 72 through the transverse groove 74, whereby the printing drum carriage means 24 is placed under the control of the socket 60 with respect to the axial movement thereof.

Thereafter the pulse motor 104 is supplied with driving electric pulses according to the adjustment position prior to the drawing out of the printing drum stored in RAM 206 of the micro computer 200 such that the prior adjustment position of the printing drum is automatically recovered.

The pulse motor 104 is selectively rotated in either rotational direction from the rotational position corresponding to the standard position according to the operation of the print image transverse position instruction button 304 or 306, and in accordance therewith the threaded shaft 99 is rotated so that the socket 60 is shifted in either axial direction so as thereby to move the printing drum carriage means 24 connected therewith along the central axis of the printing drum, while the transverse biasing amount of the print image position effected thereby is indicated by a shifting of the biased printing position indication mark 316 from the standard printing position indication mark 314 in the printing image position indication means 312. In a preferred embodiment, one time pushing of the button 304 or 306 may provide a transverse biasing of the print image of an amount of 0.5 mm.

Although in FIGS. 1 and 2 the printing drum 10 and the printing drum carriage means 24 are shown with a central portion thereof being omitted for the sake of convenience of the size of the drawing, so that the axial length of the construction is contracted relative to the dimension perpendicular thereto, the printing drum has a relatively slender configuration such that the length thereof is 2–2.5 times of the diameter thereof, and corresponding thereto the printing drum carriage means has also an elongated configuration in the axial direction of the printing drum. Therefore, when the printing drum carriage means is guided at the opposite side edge portions thereof by the pair of intermediate movable rails 26 and the pair of stationary rails 30 along the central axis thereof, the printing drum carriage means moves smoothly with no side swinging almost regardless where the driving force for moving it along the central axis is applied. Particularly when the printing drum carriage means is applied with the driving force for the axial shifting through the engagement rod 58 provided at the axial end portion as in the shown embodiment, the printing drum carriage means moves smoothly even when the driving force is applied only at one portion thereof. Particularly when the driving force is applied to the printing drum carriage means through the engagement rod 58 located relatively closely to the central axis thereof as in the shown embodiment, the printing drum carriage means moves very smoothly in the axial direction, enabling a high precision fine adjustment.

Although the present invention has been described in detail with respect to one embodiment thereof, it will be apparent for those skilled in the art that the present invention is not limited to the shown embodiment, and particularly the axial driving means for the printing drum carriage means constructed by the engagement rod 58, socket 60, threaded shaft 99, gear wheels 98 and 102, pulse motor 104, etc. employed in the shown embodiment may be replaced by various other driving means.

We claim:

1. A stencil printer comprising a frame body, a printing drum, a printing drum carriage means supporting said printing drum to be rotatable around a central axis thereof at a stationary axial position thereof, a means for suspending said printing drum carriage means from said frame body to be movable relative thereto in a transverse direction extending along the central axis of said printing drum between an operating position thereof located inside of said frame body and a dismounting position thereof located outside of said frame body, and a print image transverse position adjustment means acting between said printing drum carriage means and said frame body for adjusting a transverse position of said printing drum carriage means located at said operating position in said transverse direction relative to said frame body, wherein said print image transverse position adjustment means comprises:

a drive means supported from said frame body and having a drive element movable in said transverse direction for positioning said printing drum carriage means, when engaged therewith, in said transverse direction relative to said frame body, a print image transverse position instruction means for selectively actuating said drive means in either direction of said transverse direction, a latching means for selectively latching said printing drum carriage means to said drive element such that said printing drum carriage means is engaged with and positioned by said drive means in said transverse direction relative to said frame body, a latch disengagement instruction means for instructing said latching means for disengagement of said drive element from said printing drum carriage means such that said printing drum carriage means is movable to said dismounting position thereof, a standard position detection means for detecting a standard transverse position of said drive element corresponding to a standard transverse position of said printing drum carriage means engaged therewith, a bias measurement means for measuring a biasing amount of said drive element from said standard transverse position thereof corresponding to a transverse biasing amount of said printing drum carriage means engaged therewith from said standard transverse position thereof, and an operation control means which, when said latch disengagement instruction means is operated for disengagement of said latching means, actuates said drive means to bias said drive element, according to a biasing amount thereof, to a terminal position of biasing thereof in the direction of biasing said printing drum carriage means toward said disengagement position, and then to return said drive element to said standard transverse position thereof, with a simultaneous control of said latching means such that said latching means is disengaged at a moment when said drive element reverses direction of biasing movement thereof.

2. A stencil printer according to claim 1, wherein said print image transverse position adjustment means further comprises a bias amount memory means for storing the biasing amount of said drive element from said standard transverse position thereof before execution of said instruction of disengagement by said latch disengagement instruction means, and said operation control means operates said drive means to recover the stored biasing amount of said drive element from said standard transverse position thereof after said drive element has been returned to said standard transverse position thereof.

3. A stencil printer according to claim 1, wherein said print image transverse position adjustment means further comprises a print image position indication means for indicating a transverse adjustment position of a print image corresponding to a biasing amount of said drive element instructed by said print image transverse position instruction means, said print image position indication means comprising means for indicating a standard print position indication mark of a rectangular configuration representing a print sheet, a biased print position indication mark of a rectangular configuration, and a means for changing a transverse position of said biased print position indication mark relative to said standard print position indication mark corresponding to the biasing movement of said drive element from said standard transverse position thereof.

4. A stencil printer according to claim 1, wherein said latching means comprises an engagement rod provided in said printing drum carriage means to extend in said transverse direction with a tapered tip end and a transverse groove formed adjacent said tapered tip end, a socket means provided in said drive element to receive said engagement rod therein in alignment therewith with a transverse groove formed therein to open to a bore of said socket means, a lug means adapted to engage into said transverse groove of said socket means, a spring means for biasing said lug means to a position engaged into said transverse groove of said socket means and also into said transverse groove of said engagement rod when said engagement rod is received in the bore of said socket means at a predetermined axial relation therewith, and an actuator means for removing said lug means at least out of said transverse groove of said engagement rod received in the bore of said socket means when energized against said spring means.

* * * * *